US007770879B2

(12) United States Patent
Kazama et al.

(10) Patent No.: US 7,770,879 B2
(45) Date of Patent: Aug. 10, 2010

(54) RECORDING MEDIUM TRANSPORT APPARATUS AND IMAGE FORMING APPARATUS

(75) Inventors: Toshiyuki Kazama, Ebina (JP); Michio Tada, Ebina (JP); Ryoji Watanabe, Ebina (JP); Shouichi Maeda, Ebina (JP); Makoto Ochiai, Iwatsuki (JP); Tatsunori Izawa, Ebina (JP); Naoto Nishi, Ebina (JP); Yoshinobu Nakamura, Ebina (JP); Satoshi Kanou, Ebina (JP); Shun Yashima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/331,989

(22) Filed: Dec. 10, 2008

(65) Prior Publication Data

US 2009/0250864 A1 Oct. 8, 2009

(30) Foreign Application Priority Data

Apr. 8, 2008 (JP) ..... 2008-100806

(51) Int. Cl.
*B65H 3/44* (2006.01)

(52) U.S. Cl. ..... 271/9.01; 271/162

(58) Field of Classification Search ..... 271/9.01, 271/9.13, 162; 399/23, 391, 394
See application file for complete search history.

(56) References Cited

U.S. PATENT DOCUMENTS

| | | | | |
|---|---|---|---|---|
| 5,083,170 | A * | 1/1992 | Sawada et al. | 399/401 |
| 5,523,822 | A | 6/1996 | Tsuda | 355/208 |
| 2001/0053300 | A1 * | 12/2001 | Endo et al. | 399/394 |
| 2004/0184853 | A1 * | 9/2004 | Matsuzaka et al. | 399/394 |
| 2006/0285903 | A1 * | 12/2006 | Yamane et al. | 399/394 |
| 2008/0024808 | A1 | 1/2008 | Masuda | 358/1.12 |
| 2008/0038004 | A1 * | 2/2008 | Inoue | 399/45 |

FOREIGN PATENT DOCUMENTS

| | | |
|---|---|---|
| JP | 6-271122 | 9/1994 |
| JP | 11-189355 | 7/1999 |
| JP | 2005-206338 | 8/2005 |
| JP | 2005-241669 | 9/2005 |
| JP | 2008-233441 | 1/2008 |
| JP | 2008-32913 | 2/2008 |

* cited by examiner

*Primary Examiner*—David H Bollinger
(74) *Attorney, Agent, or Firm*—Morgan, Lewis & Bockius LLP

(57) ABSTRACT

A recording medium transport apparatus includes: plural storage units each storing a recording medium; a transport unit that transports the recording medium from one of the storage units to a recording position where an image is recorded on the recording medium; a memory that stores a reference position of a recording medium prescribed for each storage unit; a measuring unit that measures a position of the transported recording medium; and a movement unit that reads the reference position corresponding to the storage unit that stored the transported recording medium, from the memory, and moves the recording medium according to the difference between the reference position and the measured position such that the position of the recording medium approaches the reference position when the recording medium is located upstream of the recording position in the transport direction thereof.

7 Claims, 4 Drawing Sheets

| TRAY | REFERENCE POSITION |
|---|---|
| 2a | 5.5mm |
| 2b | 3.39mm |
| 2c | 7.45mm |

RECORDING MEDIUM TRANSPORT APPARATUS AND IMAGE FORMING APPARATUS

CROSS-REFERENCE TO RELATED APPLICATIONS

This application claims priority under 35 USC 119 from a Japanese patent application No. 2008-100806 filed on Apr. 8, 2008.

BACKGROUND

1. Technical Field

The present invention relates to a recording medium transport apparatus and an image forming apparatus.

2. Related Art

In an image forming apparatus, when transporting a recording medium, the position of the recording medium may become offset due to manufacturing error of a transport apparatus that transports that recording medium, variation in the accuracy of installation of the transport apparatus to the image forming apparatus, or the like.

SUMMARY

According to one aspect of the invention, there is provided a recording medium transport apparatus, including: plural storage units that store a recording medium; a transport unit that takes the recording medium from one of the plural storage units and transports the recording medium to a recording position where an image is recorded on a recording face of the recording medium; a memory that stores a reference position of a recording medium that has been prescribed for each of the storage units as a position in the direction parallel to the recording face and orthogonal to the transport direction of the recording medium; a measuring unit that measures a position in the direction parallel to the recording face and orthogonal to the transport direction of the recording medium transported by the transport unit; and a movement unit that reads the reference position corresponding to the storage unit, in which the recording medium transported by the transport unit was stored, from the memory, and moves the recording medium according to the difference between the read reference position and the position measured by the measuring unit such that the position of the recording medium approaches the read reference position when the recording medium is located upstream of the recording position in the transport direction of the recording medium.

BRIEF DESCRIPTION OF THE DRAWINGS

Exemplary embodiment(s) of the present invention will be described in detail based on the following figures, wherein.

DETAILED DESCRIPTION

Following is a description of an exemplary embodiment of the present inventions with reference to the accompanying drawings.

A. Configuration

A-1. Overall Configuration of Image Forming Apparatus

Figures 1, 5:
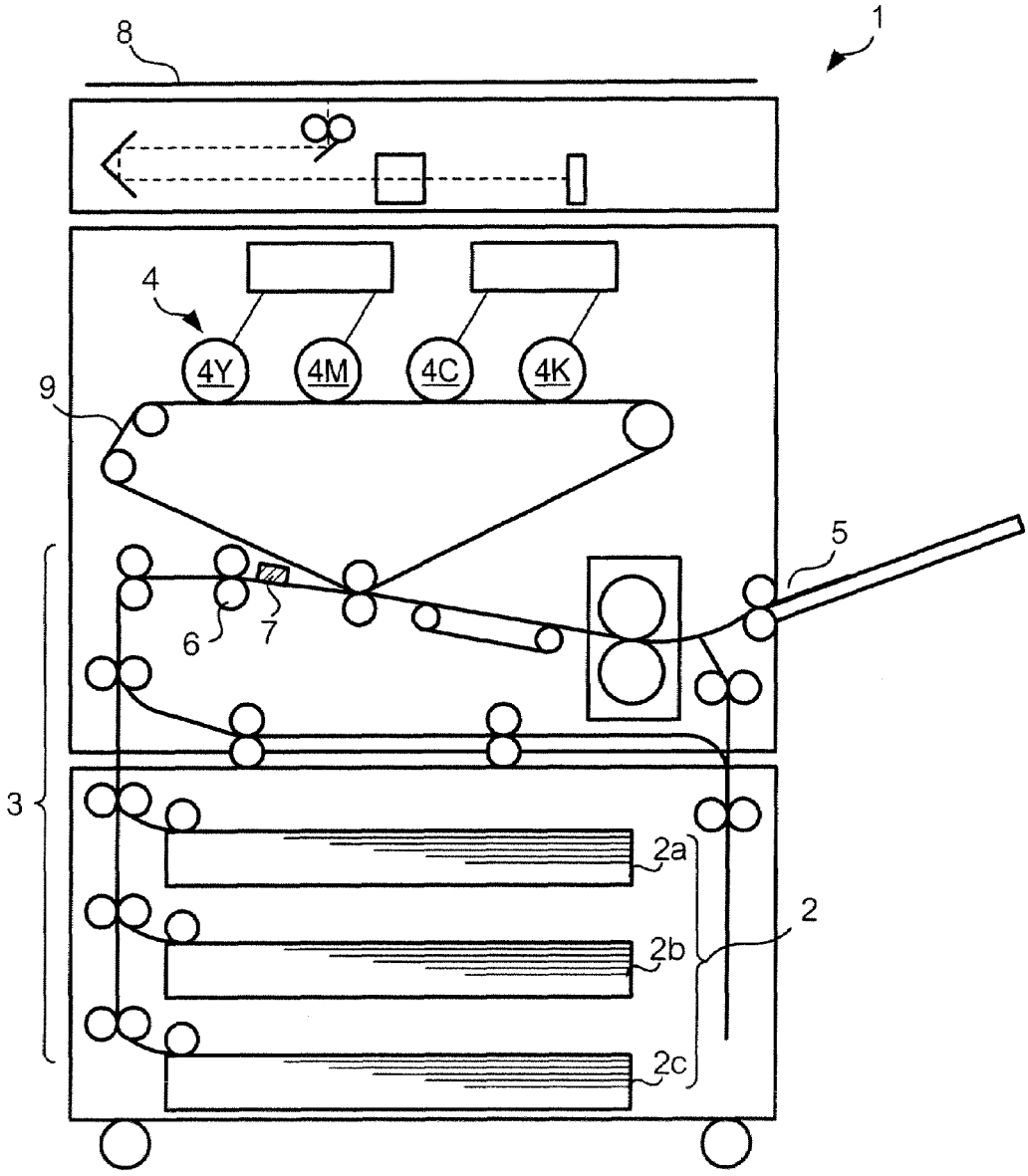
FIG. 1 illustrates an example of the general configuration of an image forming apparatus.
FIG. 5 shows the reference position of each tray that has been stored in a memory.

FIG. 1 illustrates an example of the general configuration of an image forming apparatus. An image forming apparatus 1 shown in FIG. 1 forms an image on a recording medium and outputs the formed image. Here, examples of the recording medium include paper such as plain paper or recycled paper, resin material such as OHP sheets, or the like. In the description of the present example, 'paper P' that is an example of the recording medium is used.

The image forming apparatus 1 is provided with trays 2*a*, 2*b*, and 2*c* as examples of multiple storage units that store a paper P (below, referred to as simply the trays 2 when not distinguishing between these trays), a transport unit 3 as an example of a transport unit that transports paper P that has been taken out from any tray 2 to a recording position where a toner image is recorded on a face of this paper P, image forming units 4Y, 4M, 4C, and 4K as examples of image writing units that write an image at a position, that corresponds to the reference position, of image carriers such as photosensitive bodies of multiple toner images corresponding to respective multiple color components such as YMCK, for example (below, referred to as simply the image forming units 4 when not distinguishing between these image forming units), an intermediate belt 9 as an example of a transfer unit to which the toner images that have been formed by each image forming unit 4 are transferred in a superimposed manner, and that transfers and records these toner images to the paper P transported by the transport unit 3 at a recording position, and a paper exit unit 5 the paper P exits after transfer.

Registration rollers 6 that transport the paper P to the recording position, and a CIS (Contact Image Sensor) sensor 7 as an example of a measuring unit that measures the position of the paper P transported by the transport unit 3 in a direction parallel to a recording face of the paper P and orthogonal to the transport direction of the paper P, are disposed on the upstream side in the transport direction of the paper P from the recording position of the toner images to the paper P. The registration rollers 6 are an example of a moving unit that moves the paper P in a direction parallel to the face of the paper P and orthogonal to the transport direction of the paper P. Also, here, 'orthogonal' encompasses the mathematical meaning of strictly 'orthogonal', and also encompasses angles that can be considered approximately orthogonal within the error range of mechanical precision.

Also, the image forming apparatus 1 is provided with an image reading unit 8 that optically reads and acquires, from an original, image data used as a source by the image forming units 4, and an unshown user interface unit.

A-2. Functional Configuration of Image Forming Apparatus

Figure 2:
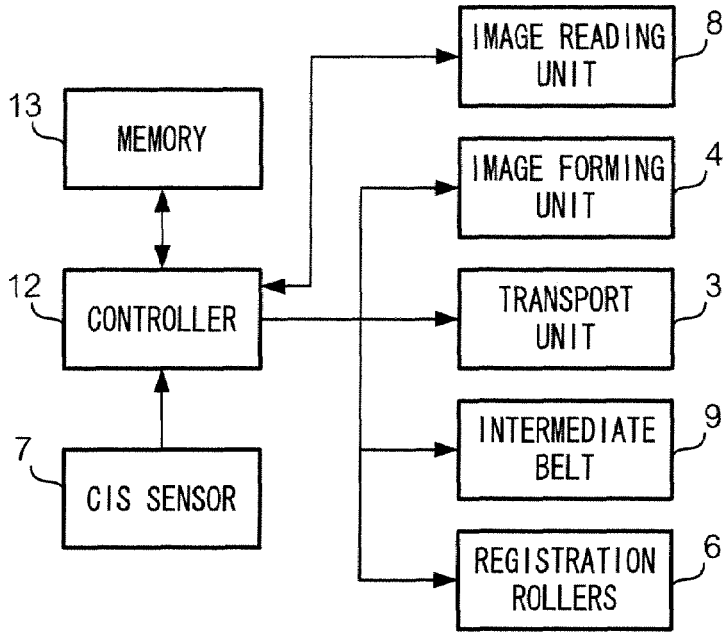
FIG. 2 illustrates an example of the functional configuration of an image forming apparatus.

FIG. 2 shows the functional configuration of the image forming apparatus 1. As shown in FIG. 2, the image forming apparatus 1 is provided with the CIS sensor 7, a controller 12, a memory 13, the registration rollers 6, the image reading unit 8, the transport unit 3, and the image forming units 4.

The transport unit 3 takes paper P from any of the trays 2, and transports this paper P to the recording position where a toner image is recorded on a face of the paper P from the intermediate belt 9.

The CIS sensor 7 measures the position of the paper P transported by the transport unit 3 in a direction parallel to the face of the paper P and orthogonal to the transport direction of the paper P, and supplies the obtained position information to the controller 12.

The memory 13 is an example of a memory that stores a reference position that has been determined for each tray 2 that stores paper P, as a position in a direction parallel to the face of the paper P and orthogonal to the transport direction of the paper P in the recording position. The reference position is a position in a direction parallel to the face of the paper P and orthogonal to the transport direction of the paper P, and is a position where the paper P is likely to be transported by the transport unit 3. Also, the memory 13 stores, in advance, data and a computer program that are necessary for processing by the controller 12.

The controller 12 includes a CPU (Central Processing Unit), a ROM (Read Only Memory), a RAM (Random Access Memory), and the like, and controls each part of the image forming apparatus 1 by reading and executing a computer program that is stored in the memory 13. Also, the controller 12, on the upstream side in the transport direction of the paper P from the recording position of the intermediate belt 9, such that the position of the paper P approaches a reference position read from the memory 13, obtains a correction amount corresponding to the difference between the read reference position and the position measured by the CIS sensor 7. Also, the controller 12 instructs the registration rollers 6 to perform correction processing of the obtained correction amount.

The registration rollers 6 are a roller pair made up of two rollers, and in a state in which the paper P is sandwiched between the pair of rollers on the upstream side in the paper transport direction from the recording position of the intermediate belt 9, moves the paper P in a direction parallel to the face of the paper P and orthogonal to the paper transport direction by the correction amount instructed from the controller 12. The shafts of the roller pair are linked to a drive mechanism configured from a motor and various gears, and the amount of movement of the registration rollers 6, i.e., the amount of movement of the paper P, is determined by the amount of rotation of this motor.

The image forming units 4 match the writing position of a latent image for forming a toner image to a position that corresponds to the reference position stored in the memory 13, in accordance with instructions from the controller 12.

A-3. Configuration of CIS Sensor and Registration Rollers

Figure 3A:
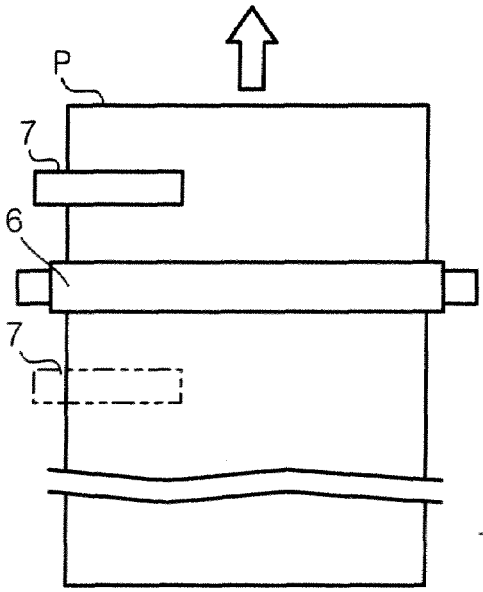
FIGS. 3A and 3B illustrate an example of the configuration of a CIS sensor.
Figure 3B:
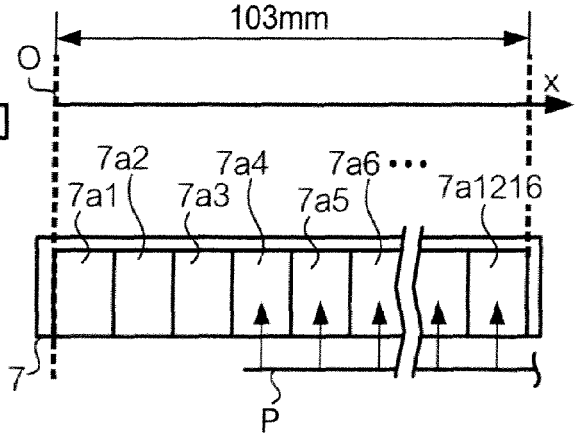

FIGS. 3A and 3B show the configuration in the vicinity of the CIS sensor 7 and the registration rollers 6. FIG. 3A shows the CIS sensor 7 and the registration rollers 6 viewed from above in FIG. 1, i.e., viewed from the face where a toner image is transferred and recorded to the paper P (referred to below as the image forming face), such that the paper transport direction is pointing upward. In FIG. 3B, the CIS sensor 7 is viewed from upstream in the paper transport direction.

As shown in FIG. 3A, both the CIS sensor 7 and the registration rollers 6 are provided on the upstream side in the paper transport direction from the recording position of a toner image to the paper P. The registration rollers 6 are positioned on the upstream side in the paper transport direction from the CIS sensor 7. The CIS sensor 7 is positioned at the left edge of the paper P when the image forming face of the paper P is viewed so that the paper transport direction is pointing upward.

The CIS sensor 7 is disposed biased to one side of the transport path of the paper P in order to detect the edge position of one side of the paper P. Also, such that it is possible for one CIS sensor 7 to be compatible with large and small paper sizes, the CIS sensor 7 has a detection width of a predetermined size in the direction orthogonal to the paper transport direction.

As shown in FIG. 3B, this sort of CIS sensor 7 is configured with 1216 light-receiving elements 7*a*1 to 7*a*1216 (below, referred to as simply the light-receiving elements 7*a* when not distinguishing between these light-receiving elements) arranged in the direction orthogonal to the paper transport direction. When irradiated light from a light source such as multiple LEDs or the like arranged in the direction that the light-receiving elements 7*a* are lined up is reflected by a detected object such as paper, that reflected light is received by the light-receiving elements 7*a*. With this CIS sensor 7, the resolution when performing measurement is specified depending on the number of light-receiving elements 7*a*. In the present exemplary embodiment, the CIS sensor 7 has a maximum measurement width of 103 mm, in other words 1216 pixels, in the rightward direction in FIG. 3B, which is the direction that intersects the paper transport direction, from the origin point O shown in FIG. 3B, and the CIS sensor 7 has a resolution of 300 dpi within that maximum measurement width.

Here, the position where the registration rollers 6 sandwich the paper P in order to move the paper P is the leading edge (i.e., the downstream side) of the paper P in the paper transport direction as shown in FIG. 3. On the other hand, when the registration rollers 6 sandwich the paper P, at the trailing edge (i.e., the upstream side) of the paper P in the paper transport direction, a non-releasable paper holder (such as a retard roller that prevents double feeding or the like) may be present in the mechanism of the transport unit 3. Therefore, it is necessary that in a state in which the trailing edge of the paper is held by the paper holder, the registration rollers 6 move the paper P in the direction orthogonal to the paper transport direction. At this time, if the movement amount that the registration rollers 6 move the paper P is large, the paper P will become twisted, causing damage or skewing of the paper P and transfer defects, so it is desirable that the movement amount is made as small as possible.

B. Operation

B-1. Reference Position Calculation Operation

Next is a description of a reference position calculation operation. As described above, the memory 13 stores a reference position for each tray 2. Processing to calculate and write the reference position of each tray in the memory 13 is, for example, performed at the time of shipment of the image forming apparatus 1 by the controller 12.

Figure 4:
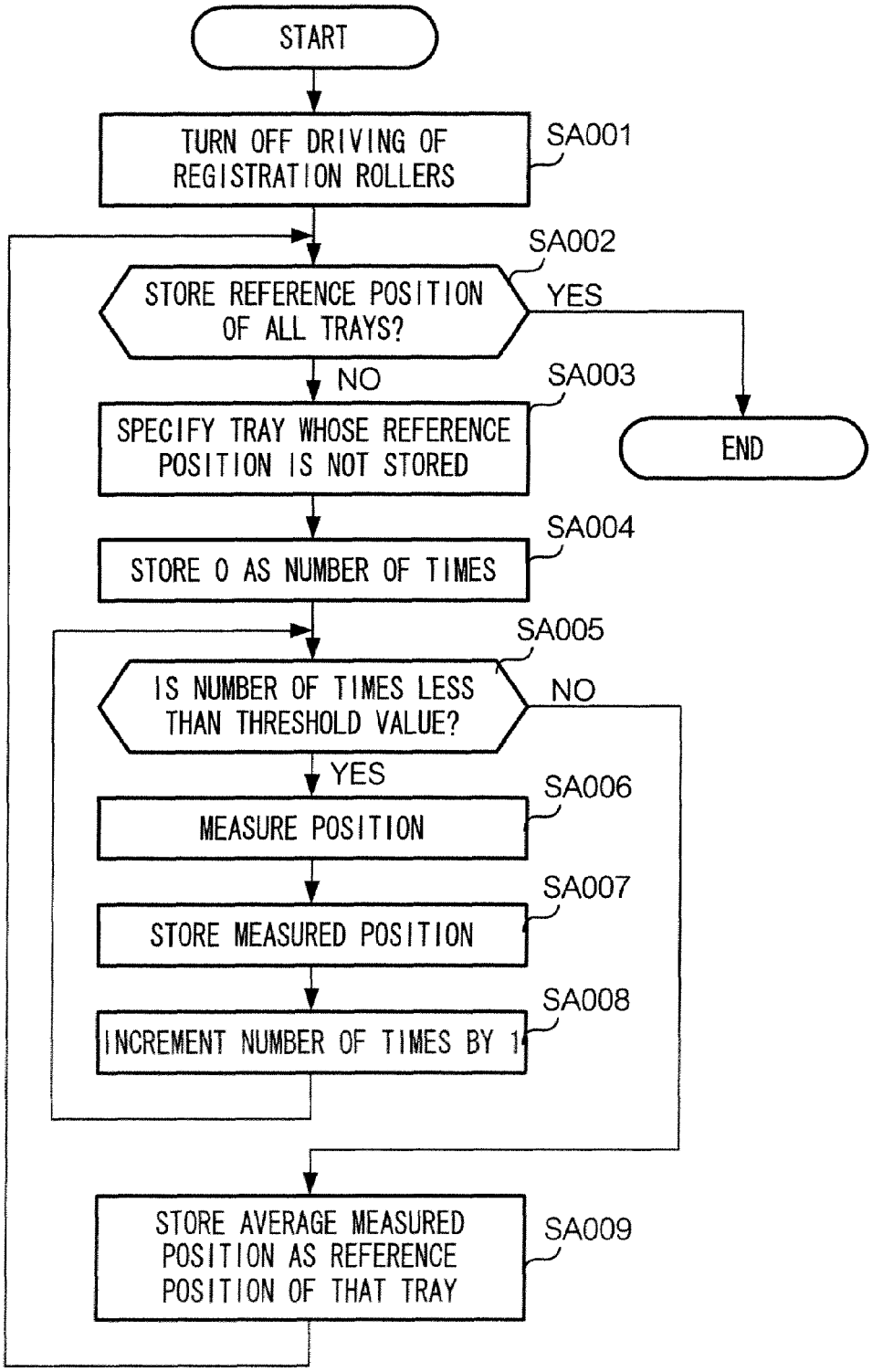
FIG. 4 is a flowchart for illustrating the flow of a reference position calculation operation.

FIG. 4 is a flowchart for illustrating the flow of the reference position calculation operation.

First, the controller 12 turns off driving of the paper P by the registration rollers 6 in the direction orthogonal to the transport direction, and establishes a state in which movement of the paper P by the registration rollers 6 in the direction orthogonal to the transport direction is prohibited (Step SA001). Next, the controller 12 refers to the memory 13 to determine whether or not a reference position is stored for all trays (Step SA002). Here, when it is determined that a reference position is stored for all trays (Step SA002; YES), the controller 12 ends the reference position calculation operation.

On the other hand, when it is determined that a reference position is not stored for all trays (Step SA002; NO) the controller 12 specifies a tray 2 for which a reference position is not stored (Step SA003), and stores '0' as the number of times measurement of the reference position for calculation has been performed (Step SA004). Next, the controller 12 compares the number of times to a threshold value that has been stored in advance in the memory, and determines whether or not the number of times is less than the threshold value (Step SA005). When the result of this determination is that the number of times is less than the threshold value (Step SA005; YES), the controller 12 causes the paper to be taken out from that tray 2 and transported by the transport unit 3, and measures the position of the paper P in the direction orthogonal to the transport direction with the CIS sensor 7 (Step SA006). Then, the controller 12 stores the measured position that was obtained in the memory 13 (Step SA007) and increments the number of times by 1 (Step SA008). Steps SA005 to SA008 are repeated in this manner, and when the number of times becomes at least the threshold value (Step SA005; NO), the controller 12 calculates an average value of the measured positions stored in the memory 13 by arithmetic average, and stores this average value as the reference position of that tray 2 (Step SA009). Afterward, the controller 12 returns to the processing in Step SA002, and performs the determination described above. For example, if the threshold value is 3, in Step SA005, when the number of times is 0, 1, or 2, the controller 12 performs measurement (Step SA006), and when the number of times becomes three, calculates the average value of the measured positions. In other words, position measurement is performed for that tray 2 the number of times indicated by the threshold value.

FIG. 5 shows the reference position of each tray 2 that has been stored in the memory 13. For example, in the reference position calculation for the tray 2*a*, in a state in which movement of the paper P by the registration rollers 6 is prohibited, the paper P is transported three times. 5.2 mm, 5.8 mm, and 5.5 mm have been stored as the measured positions of that paper P, so a calculated average value of 5.5 mm is written to the memory 13 as the reference position corresponding to the tray 2*a*. These measured positions are distances measured in the rightward direction in FIG. 3B, which is the direction that intersects the paper transport direction, from the origin point O shown in FIG. 3B and are measured from the positions of the light-receiving elements 7*a* that received reflected light and the light-receiving elements 7*a* that did not receive reflected light.

The reference position is the average position measured by the CIS sensor 7 when the transport unit 3 has actually taken the paper P from the specified tray 2 and transported that paper P, so it is likely that the paper P taken from this tray 2 will be transported by the transport unit 3 to a position near this reference position. Note that the method for calculating the reference position is not limited to simply an average of the positions measured multiple times as in the present exemplary embodiment; a method may also be adopted in which measurement values other than the maximum and minimum values are averaged, or in which an abnormal value far removed from the other measured values is excluded and the remaining values are averaged. In this case, in a state in which movement of the paper P in the direction orthogonal to the transport direction of the paper P by the registration rollers 6 is prohibited, the transport unit 3 takes multiple sheets of the paper P from a specified tray 2 and transports those sheets, and the reference position is calculated from each position that has been measured by the CIS sensor 7 for the multiple sheets of the paper P.

B-2. Image Forming Operation

Figure 6:
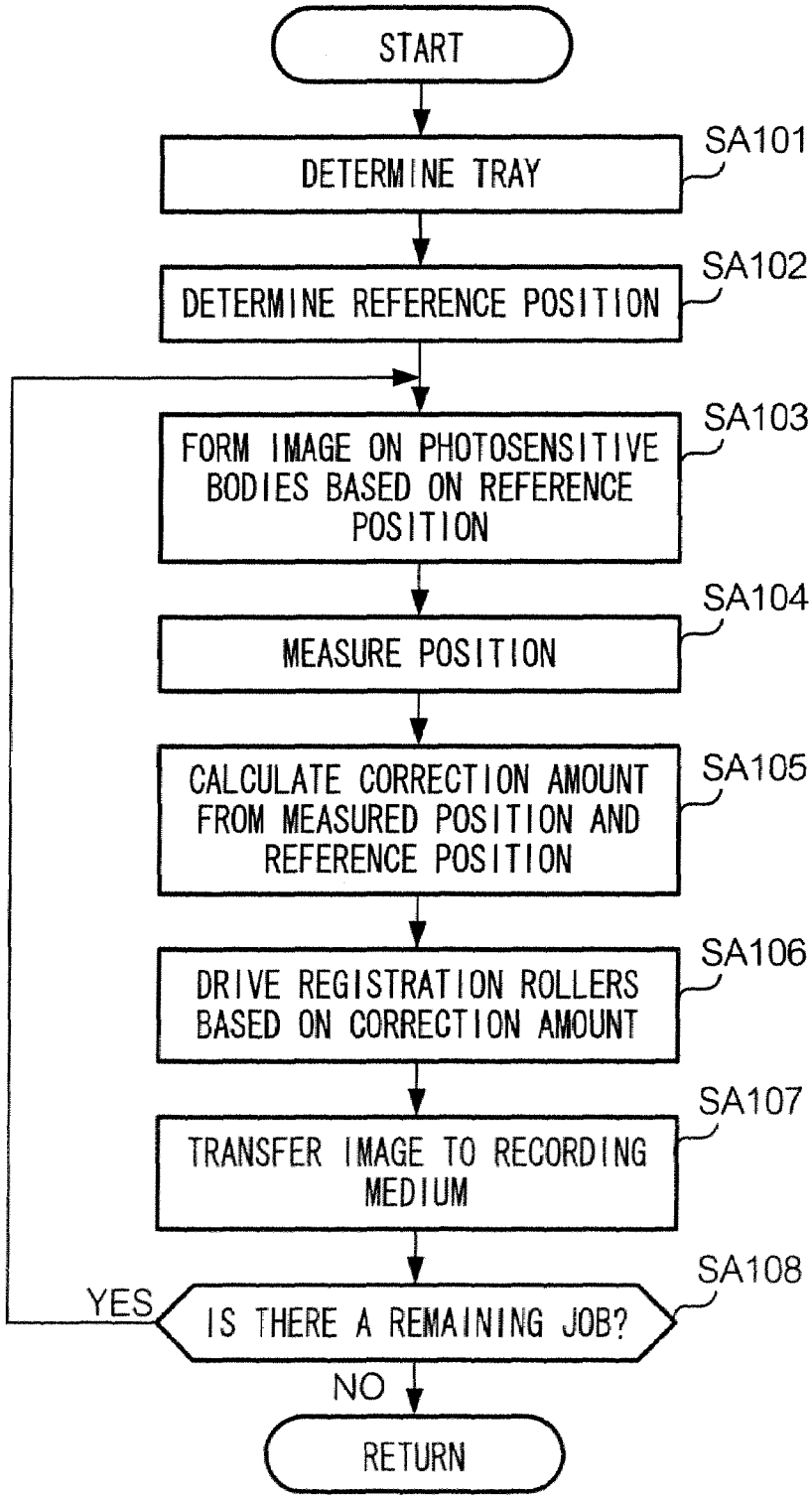
FIG. 6 is a flowchart for illustrating the flow of an image forming operation.

Next is a description of an image forming operation. FIG. 6 is a flowchart for illustrating the flow of the image forming operation. First, when there is an image forming instruction from a user, the controller 12 determines the tray 2 from which the paper P will be taken (Step SA 1001), and reads the reference position that corresponds to this tray 2 from the memory 13 (Step SA102). Next, the controller 12 forms toner images at positions corresponding to the reference positions on the photosensitive bodies of the image forming units 4 (Step SA103), causes the transport unit 3 to take the paper P from the tray 2 determined in Step SA101 and transport that paper P, and causes the CIS sensor 7 to measure the position in the direction orthogonal to the transport direction of the transported paper P (Step SA104). Then, the controller 12 calculates a correction amount from the difference between the measured value and the reference position (Step SA105), and drives the registration rollers 6 based on the correction amount to move the paper P (Step SA106). For example, when the reference position is 5.5 mm and the measured position is 4.5 mm, the correction amount is 1.0 mm. Accordingly, in this case, the registration rollers 6 sandwich the paper P, and move the paper P 1.0 mm in the rightward direction in FIG. 3B, which is the direction that intersects the paper transport direction, from the origin point O shown in FIG. 3B. As a result, the position of the left edge of the paper P moves closer to the reference position.

Afterward, the toner images formed and held on the photosensitive bodies of the image forming units 4 are reproduced, in a superimposed manner, on the surface of the intermediate belt 9, and transferred and recorded by the intermediate belt 9 to the paper P transported to the recording position by the transport unit 3 (Step SA107). The controller 12 determines whether or not there is a remaining job (Step SA108), and when it is determined that there is a remaining job (Step SA108; YES), returns the processing to Step SA103. On the other hand, when it is determined that there is not a remaining job (Step SA108; NO), this processing is returned to the point from which it was invoked.

Due to mechanical precision of portion connecting the tray 2 and the transport unit 3, or the like, the position of the recording medium taken from the tray 2 is uniquely offset in a direction parallel to the face of the recording medium and orthogonal to the transport direction when the recording medium has been transported to the recording position, and the numerical value of this position offset is approximately the same for each tray 2. In the image forming apparatus 1 described above, the average of positions measured multiple times for a tray 2 is used as the reference position of that tray 2, so the maximum value of offset from the reference position of the transported recording medium is reduced in comparison to a case where a single reference position is set for all of the trays 2.

C. Modified Examples

The exemplary embodiment described above may be modified in the following manner. Also, the examples modified in the following manner may be appropriately combined with the exemplary embodiment described above.

C-1. In the above exemplary embodiment, start conditions of the reference position calculation processing are not particularly mentioned, but various start conditions may be provided. For example, the above reference position calculation processing may be performed when an unshown operation unit has received an instruction from a user to perform the reference position calculation processing. Also, it is necessary to calculate a reference position for the trays 2, which are paper P storage units, when exchanging components of the trays 2 or when newly providing an additional tray 2. Accordingly, a configuration may be adopted in which a detection unit that detects that a tray 2 has been installed is provided, and when the detection unit detects that a tray has been installed, the above reference position calculation processing is automatically performed. In this case, for example, the image forming apparatus 1 has a button-like switch or the like that has been biased with an elastic body, as an example of a detection unit that detects that a tray 2 has been installed at an installation position. In a state in which a tray 2 is not installed, this switch is separated from an internal connection point by biasing force of the elastic body, so a predetermined signal is not sent to the controller 12. When a tray 2 is installed, the internal connection point makes contact in opposition to the biasing force, so the predetermined signal is sent to the controller 12. The controller 12 may perform the above reference position calculation processing whenever a signal is received from this switch.

C-2. In the above exemplary embodiment, with attention focused on the fact that the position of the paper P differs for each of the trays 2, which are the storage units of that paper P, the reference position of the paper P is stored for each of the trays 2, and the position of the paper P is corrected according to the difference between that reference position and the measured position. Here, the reason that the position of the paper differs for each of the trays 2 which are the storage units of the paper P, is at least one of that the position of paper differs due to tray installation error in a state in which paper is stored in the trays 2, or that the paper position changes during transport from the trays 2 to the recording position.

Here, when the paper transport path is considered to be a region that paper passes through from the trays 2 until arrival at the recording position, including the trays 2, which are the paper storage units, with respect to both of the above reasons, the position of the paper P differs for each transport path of that paper. The following can be expressed when the exemplary embodiment is viewed from such a viewpoint.

That is, this exemplary embodiment is a position correction apparatus provided with a transport unit having multiple transport paths, the transport unit transporting a recording medium to a recording position where an image is transferred and recorded to the recording medium, via any of the multiple transport paths; a memory that stores a reference position that has been prescribed for each of the transport paths as a position in the direction orthogonal to the transport direction of the recording medium, in the transfer position; a measuring unit that measures the position in the direction orthogonal to the transport direction of the recording medium transported by the transport unit; and a movement unit that reads the reference position corresponding to the transport path of the recording medium transported by the transport unit from the memory, and moves the recording medium according to the difference between the read reference position and the position measured by the measuring unit such that the position of the recording medium approaches the read reference position on the upstream side in the transport direction of the recording medium from the recording position. An example of the transport unit of this position correction apparatus is the transport unit 3 of the above exemplary embodiment, an example of the memory is the memory 13 of the above exemplary embodiment, an example of the measuring unit is the CIS sensor 7 of the above exemplary embodiment and an example of the movement unit is the registration rollers 6 of the above exemplary embodiment.

C-3. In particular, with respect to the paper transport path, in duplex printing a distinction may be made between a 'front side printing' transport path and a 'back side printing' transport path. The reason for this is that, in duplex printing, after the recording medium has been transported to a reversing mechanism, the recording medium is reversed and again transported to the recording position, so both the transport path and the transport distance differ between when an image is transferred and recorded to the front side of the recording medium and when recorded to the back side; accordingly, due to the difference in these transport paths and transport distances, the position during transfer and recording often differs. In this case, for example, the memory 13 stores two reference positions for each tray 2. That is, a configuration may be adopted in which the controller 13 stores, as a first reference position, an average obtained by measuring the position when the transport unit 3 transports one face of the paper P as a recording face, and stores, as a second reference position, an average of the position measured when the transport unit 3 transports the other face of the paper P as a recording face after the paper P has been reversed by a switchback mechanism or the like. In this configuration, when the transport unit 3 transports one face of the paper P as a recording face, the memory 13 reads the first reference position as the reference position to perform position correction, and when the transport unit 3 transports the other face of the paper P as a recording face, the memory 13 reads the second reference position as the reference position to perform position correction.

C-4. In the above exemplary embodiments, the registration rollers 6 are positioned on the upstream side in the paper transport direction from the CIS 2*a* sensor 7, but as indicated by the broken line in FIG. 3A, the CIS sensor 7 may be positioned on the upstream side in the paper transport direction from the registration rollers 6.

C-5. In the above exemplary embodiment, the registration rollers 6 move the paper P a correction amount that corrects the difference between the reference position read from the memory 13 and the position measured by the CIS sensor 7, in order to move the position of the left edge of the paper P closer to the read reference position, but it is not necessary to move the paper P by that difference as the correction amount. In other words, the registration rollers may perform correction processing of a correction amount according to that difference. For example, a configuration may be adopted in which by limiting the disposition of the registration rollers 6, or limiting the strength of the recording medium, when an upper limit value (for example, such as 2 mm) that the recording medium can be moved is prescribed, if the difference between the read reference position and the position measured by the CIS sensor 7 exceeds the upper limit value (for example, such as 2.2 mm), this upper limit value is used as the correction amount. In this case as well, the upper limit value corresponds to the distance corresponding to the difference between the read reference position and the measured position).

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium transport apparatus, comprising:

a plurality of storage units that store a recording medium;

a transport unit that takes the recording medium from one of the plurality of storage units and transports the recording medium to a recording position where an image is recorded on a recording face of the recording medium;

a memory that stores a reference position of a recording medium that has been prescribed for each of the storage units as a position in the direction parallel to the recording face and orthogonal to the transport direction of the recording medium;

a measuring unit that measures a position in the direction parallel to the recording face and orthogonal to the transport direction of the recording medium transported by the transport unit; and a movement unit that reads the reference position corresponding to the storage unit, in which the recording medium transported by the transport unit was stored, from the memory, and moves the recording medium according to the difference between the read reference position and the position measured by the measuring unit such that the position of the recording medium approaches the read reference position when the recording medium is located upstream of the recording position in the transport direction of the recording medium.

2. The recording medium transport apparatus according to claim 1, wherein the reference position is calculated from positions of each of a plurality of recording media measured by the measuring unit, each of the plurality of recording media has been taken from the storage unit and transported by the transport unit in a state in which movement of the recording medium by the movement unit is prohibited.

3. The recording medium transport apparatus according to claim 2, further comprising a detection unit that detects that the storage unit has been installed at an installation position of the storage unit, wherein, when the detection unit detects that the storage unit has been installed, the reference position for each of the plurality of recording media is written to the memory and thus stored as the reference position corresponding to the storage unit.

4. The recording medium transport apparatus according to claim 1, wherein the memory stores, for each of the storage units, as the reference position, a first reference position when the transport unit transports one face of the recording medium as the recording face, and a second reference position when the transport unit reverses the recording medium and transports the other face as the recording face, and the movement unit reads from the memory, as the reference position corresponding to the storage unit in which the recording medium was stored, the first reference position when the transport unit transports the one face of the recording medium as the recording face, and the second reference position when the transport unit transports the other face as the recording face.

5. An image forming apparatus, comprising:

a recording medium transport apparatus, comprising:

a plurality of storage units that store a recording medium, a transport unit that takes the recording medium from one of the plurality of storage units and transports the recording medium to a recording position where an image is recorded on a recording face of the recording medium;

a memory that stores a reference position of a recording medium that has been prescribed for each of the storage units as a position in the direction parallel to the recording face and orthogonal to the transport direction of the recording medium;

a measuring unit that measures a position in the direction parallel to the recording face and orthogonal to the transport direction of the recording medium transported by the transport unit; and a movement unit that reads the reference position corresponding to the storage unit, in which the recording medium transported by the transport unit was stored, from the memory, and moves the recording medium according to the difference between the read reference position and the position measured by the measuring unit such that the position of the recording medium approaches the read reference position when the recording medium is located upstream of the recording position in the transport direction of the recording medium; and an image forming unit that forms an image at a position corresponding to the reference position.

6. The image forming apparatus according to claim 5, wherein the image forming unit comprises:

an image carrier that carries an image;

an image writing unit that writes an image at a position on the image carrier corresponding to the reference position; and a transfer unit that transfers and records the image to the recording medium.

7. A recording medium transport apparatus, comprising:

a storage unit that stores a recording medium;

a transport unit that takes the recording medium from the storage unit and transports the recording medium to a recording position where an image is recorded on a recording face of the recording medium;

a memory that stores a reference position of a recording medium that has been prescribed as a position in the direction parallel to the recording face and orthogonal to the transport direction of the recording medium;

a measuring unit that measures a position in the direction parallel to the recording face and orthogonal to the transport direction of the recording medium transported by the transport unit; and a movement unit that reads the reference position from the memory, and moves the recording medium according to the difference between the read reference position and the position measured by the measuring unit such that the position of the recording medium approaches the read reference position when the recording medium is located upstream of the recording position in the transport direction of the recording medium.

* * * * *